US008141544B1

(12) United States Patent
Bills

(10) Patent No.: US 8,141,544 B1
(45) Date of Patent: Mar. 27, 2012

(54) CARBURETOR SYSTEM WITH A RETURN LINE TO THE FUEL TANK

(75) Inventor: Allen Bills, Houston, TX (US)

(73) Assignee: Owen Massey, Houston, TX (US)

( * ) Notice: Subject to any disclaimer, the term of this patent is extended or adjusted under 35 U.S.C. 154(b) by 78 days.

(21) Appl. No.: 12/051,084

(22) Filed: Mar. 19, 2008

(51) Int. Cl.
*F02M 37/00* (2006.01)
*F02M 5/10* (2006.01)

(52) U.S. Cl. ..... 123/514; 123/517; 123/579; 123/580; 123/511; 261/23.2; 261/36.2

(58) Field of Classification Search ..... 123/510, 123/511, 514, 432, 515, 517, 579, 580, 590, 123/591, 184.46; 261/23.2, 23.3, 23.4, 72.2, 261/36.2; 239/590, 592
See application file for complete search history.

(56) References Cited

U.S. PATENT DOCUMENTS 2,965,086 A * 12/1960 Gregory et al. ..... 123/517
4,084,564 A * 4/1978 Rickert ..... 123/514
4,173,958 A * 11/1979 Kato et al. ..... 123/514
4,834,132 A * 5/1989 Sasaki et al. ..... 137/143
4,838,307 A * 6/1989 Sasaki et al. ..... 137/574
4,860,714 A * 8/1989 Bucci ..... 123/514
5,133,324 A * 7/1992 Michiaki ..... 123/514
5,289,810 A * 3/1994 Bauer et al. ..... 123/510
5,564,397 A * 10/1996 Kleppner et al. ..... 123/514
6,058,911 A * 5/2000 Hashimoto et al. ..... 123/514
6,065,683 A * 5/2000 Akin et al. ..... 239/5

* cited by examiner

*Primary Examiner* — Stephen K Cronin
*Assistant Examiner* — Raza Najmuddin
(74) *Attorney, Agent, or Firm* — Egbert Law Offices PLLC

(57) ABSTRACT

A fuel system for a vehicle has a fuel tank, a fuel line in communication with the fuel tank, a carburetor having an inlet side and an outlet side, a return line connected to the outlet side of the carburetor and communicating with the fuel tank, and a nozzle positioned in the return line. The fuel line is connected to the inlet side of said carburetor so as to pass fuel into a fuel bowl of the carburetor. The nozzle has an orifice formed therethrough. The orifice of the nozzle has a diameter of between 0.005 and 0.050 inches. The nozzle is in sealed relationship with an inner wall of the return line.

18 Claims, 2 Drawing Sheets

FRONT OF TAPERED NOZZLE

CROSS SECTION OF FUEL BOWL
(EITHER PRIMARY OR SECONDARY)

CARBURETOR SYSTEM WITH A RETURN LINE TO THE FUEL TANK

CROSS-REFERENCE TO RELATED APPLICATIONS

Not applicable.

STATEMENT REGARDING FEDERALLY SPONSORED RESEARCH OR DEVELOPMENT

Not applicable.

NAMES OF THE PARTIES TO A JOINT RESEARCH AGREEMENT

Not applicable.

INCORPORATION-BY-REFERENCE OF MATERIALS SUBMITTED ON A COMPACT DISC

Not applicable.

BACKGROUND OF THE INVENTION

1. Field of the Invention

The present invention relates to carburetors as used with motor vehicles. More particularly, the present invention the relates to carburetors that cause the return of fuel from the carburetor to the fuel tank. Additionally, the present invention relates to a return line from the carburetor that has a nozzle positioned therein.

2. Description of Related Art Including Information Disclosed Under 37 CFR 1.97 and 37 CFR 1.98.

Carburetors are used in motor vehicles for passing the fuel into the engine for combustion. In the carburetor, the fuel is mixed with air for delivery into the cylinders. Conventional carburetors utilize inlets that serve to deliver the fuel for mixture with the air. In particular, the fuel is delivered through a needle-and-seat valve so as to accumulate within a fuel bowl within the carburetor. It can then be passed as a fuel/air mixture from the fuel bowl into the engine. Conventionally, carburetors have outlet openings formed thereon. Typically, these outlet openings are closed.

In normal use, as fuel leaves the fuel tank, the fuel proceeds through the fuel line to either an electric fuel pump or a mechanical fuel pump and to a fuel regulator. The fuel then flows through a fuel filter so as to eventually make its way into the fuel inlets on one side of the carburetor. The fuel awaits propulsion into the jets by continuing up through the needle-and-seat and into the bowls of the carburetor. Ultimately, the fuel is transmitted to venturis where it is mixed with ambient air and sent down the intake manifold such that combustion can occur within the engine.

With conventional carburetion systems, as the vehicle is driven on the freeway or sitting in traffic, the fuel remains standing in the fuel lines and absorbs heat from various sources before actually entering into the carburetor fuel bowls. These sources of heat can include heat from the radiator, engine heat (from the intake manifold, the exhaust manifold or the headers, and the engine block) and ambient air temperature (most critical during the summer months). As a result of these external heat sources, the fuel becomes superheated and begins to boil in the lines before reaching the bowls on the carburetor. Once this superheated fuel enters the fuel bowl, it percolates so as to create an aerated fuel. Upon acceleration, this aerated fuel enters into the jets located in the metering block of the carburetor and effectively leans out the carburetor. This ultimately creates a stalling condition, commonly referred to as a vapor lock. Thus, there is a need for a fuel return line that causes fuel to pass back to the fuel tank so that the fuel does not vaporize before reaching the carburetor.

In the past, various patents have issued relating to fuel systems that incorporate a return line to the fuel tank. For example, U.S. Pat. No. 4,173,958, issued on Nov. 13, 1979 to Kato et al., teaches a carburetor in a fuel system in a vehicle. This fuel system includes a fuel tank, a fuel pump for delivering fuel from the fuel tank to the carburetor under pressure, and a return line which returns fuel from the carburetor to the fuel tank when an excess amount of fuel is delivered to the carburetor by the fuel pump. The carburetor further includes a check valve in the return line for preventing the flow of fuel in the return line in a direction from the fuel tank to the carburetor. As such, the fuel flowing backwardly through the return line is prevented from leaking into the carburetor when the vehicle is turned upside down in an accident.

U.S. Pat. No. 4,175,527, issued on Nov. 27, 1979 to Sanada et al., shows a fuel supply system for engines. This fuel supply system has a fuel tank divided into first and second chambers, a fuel supply passage having a fuel pump for supplying fuel from the fuel tank to a carburetor of the engine, and a fuel return passage for returning the excess fuel supplied to the carburetor to the second chamber of the fuel tank. An upper region of the second chamber is bled, while the first chamber is supplied with new fuel. The fuel supply passage includes a change-over valve which usually connects the fuel supply passage to the first chamber.

U.S. Pat. No. 4,195,608, issued on Apr. 1, 1980 to Sanada et al., teaches a fuel supply system for engines having a carburetor. The carburetor has a float chamber and a vapor bleed passage connected to the float chamber. A portion of a fuel supply passage supplies fuel from a fuel tank to the carburetor and traverses through the float chamber so that the fuel flowing through the fuel supply passage absorbs heat from the fuel contained in the float chamber. The fuel entering into the float chamber releases volatile light components as vapor towards the vapor bleed passage while the liquid fuel contained in the float chamber becomes a more stable liquid due to the release of volatile components and the cooling effected by heat exchange with the fuel flowing through the fuel supply passage.

U.S. Pat. No. 4,582,039, issued on Apr. 15, 1986 to H. Nishida, shows a fuel supply system having a suction-type fuel supply so as to supply fuel through a fuel pump to a carburetor which is located at a level higher than the fuel level of the main fuel tank. A reserve fuel tank is provided on the line connecting the main fuel tank with the fuel pump. The reserve tank is at a level higher than the carburetor and the fuel pump. The fuel outlet of the reserve tank is located at a level lower than the fuel inlet.

U.S. Pat. No. 4,811,718, issued on Mar. 14, 1989 to S. Sonoda, shows a fuel supply system having a suction pump provided in a fuel supply passage, a ventilation passage for allowing interior space of a fuel tank to be communicated with the atmosphere, a normally-closed ventilation valve disposed in the ventilation passage, and a normally-closed release valve disposed in the fuel return passage. The normally-closed release valve is adapted for opening the fuel return passage at the time of start-up of the engine.

U.S. Pat. No. 4,835,866, issued on Jun. 6, 1989 to A. Nagashima, provides a construction for mounting a carburetor on a machine. This construction has a driving internal combustion engine, such as a portable chain saw. The carburetor is directly fixed to a fuel tank annexed to the engine and the mixture delivery side of the carburetor is connected through a resilient heat-insulating pipe to the suction port of the internal combustion engine.

U.S. Pat. No. 6,655,335, issued on Dec. 2, 2003 to Imafuku et al., discloses a small engine for outdoor power equipment. Fuel is pumped to the engine's combustion chamber by a reciprocating piston. Undesired engine racing is avoided by restricting airflow to the carburetor. A choke mechanism is provided with a pair of end portions. One of the pair of end portions closes air to the carburetor for starting and the other provides a spaced barrier for inhibiting blow-back.

U.S. Pat. No. 6,840,262, issued on Jan. 11, 2005 to T. Kojima, teaches a fuel blocking valve device having a housing attached to a fuel tank of a vehicle. A communication path extends between an inside and an outside of the fuel tank. A float valve serves to close the communication path when fuel flows into the housing. A two-way valve is disposed above the float vale for opening and closing according to an inner pressure of the tank.

U.S. Pat. No. 6,901,892, issued on Jun. 7, 2005 to Mavinahally, provides a two-stroke internal combustion engine which has at least one gaseous communication passage between a crankcase chamber and a combustion chamber of the engine. A first rotary shut-off valve on a periphery of a rotatable circular disk is operatively disposed between the passage and the crankcase chamber and rotatably connected to a crankshaft of the engine.

It is an object of the present invention to provide a fuel system for a vehicle that effectively cools the fuel passing through the fuel line.

It is another object of the present invention to provide a fuel system for a vehicle that allows the vehicle to run more efficiently.

It is another object of the present invention to provide a fuel system for a vehicle that serves to eliminate vapor locks.

It is an object of the present invention to provide a fuel system for a vehicle that improves fuel mileage.

It is still another object of the present invention to provide a fuel system for a vehicle that serves to reduce emissions.

These and other objects and advantages of the present invention will become apparent from a reading of the attached specification and appended claims.

BRIEF SUMMARY OF THE INVENTION

The present invention is a fuel system for a vehicle that comprises a fuel tank, a fuel line in communication with the fuel tank, a carburetor having an inlet side and an outlet side, a return line connected to the outlet side of the carburetor, and a nozzle positioned in the return line. The fuel line is connected to the inlet side of the carburetor so as to pass fuel into a fuel bowl of the carburetor. The return line communicates with the fuel tank. The nozzle has an orifice formed therethrough.

In the present invention, the orifice has a diameter of between 0.005 and 0.050 inches. Preferably, the orifice has a diameter of 0.031 inches. In particular, the orifice is positioned off-center of the nozzle adjacent a bottom of the nozzle. The nozzle is tapered so as to have a wide end adjacent the outlet side of the carburetor and a narrow end opposite the wide end. The return line opens to the fuel bowl of the carburetor. This return line is separate from the fuel line.

A fuel pumping means is connected to the fuel line for passing fuel at a desired rate from the fuel tank through the fuel line to the carburetor. A fuel regulator and a fuel filter may also be attached to the fuel line.

In the present invention, the carburetor can have a pair of inlets at the inlet side and a pair of outlets at the outlet side. The fuel line is split into a first portion connected to one of the pair of inlets and a second portion connected to the other of the pair of inlets. The return line is split into a first portion connected to one of the pair of outlets and a second portion connected to the other of the pair of outlets. The nozzle is positioned at a downstream position of both of the first portion and the second portion of the return line. The carburetor has a primary fuel bowl and a secondary fuel bowl. One of the pair of inlets is connected to the primary fuel bowl. The other of the pair of inlets is connected to the secondary fuel bowl. One of the pair of outlets is connected to the primary fuel bowl while the other of the pair of outlets is connected to the secondary fuel bowl.

In the present invention, the nozzle will have a surface in sealed relationship with an inner wall of the return line.

DETAILED DESCRIPTION OF THE INVENTION

Figure 1:
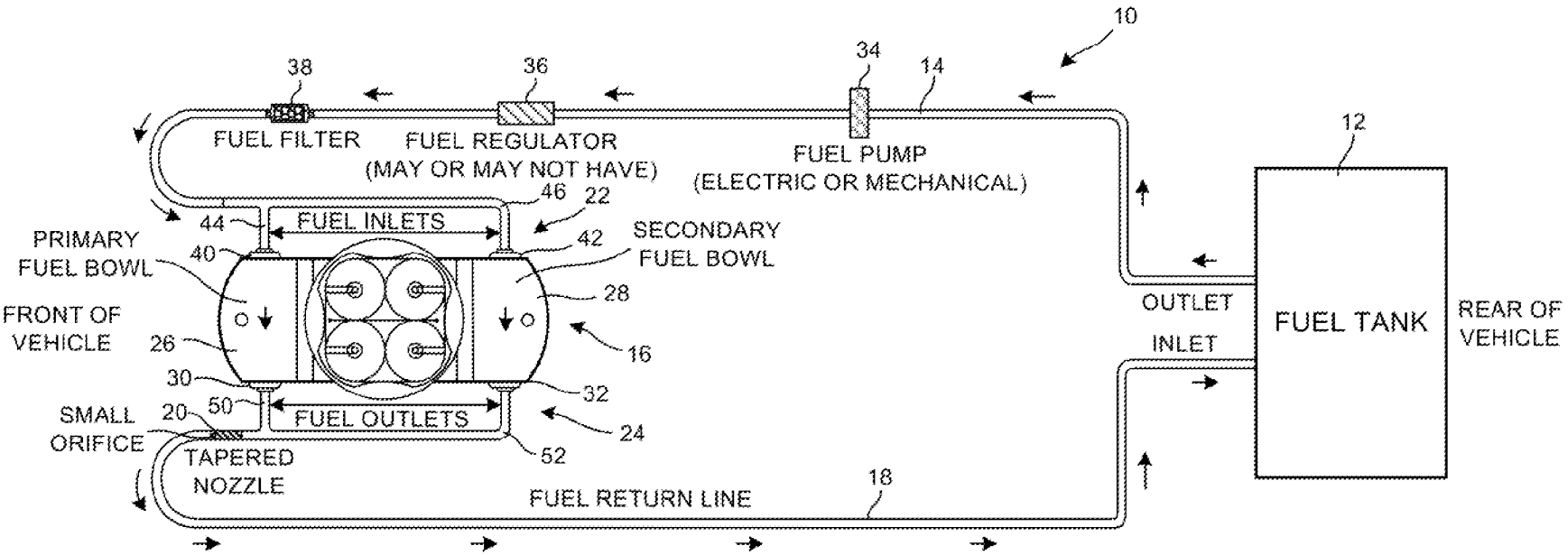
FIG. 1 is a diagrammatic illustration of the fuel system in accordance with the teachings of the preferred embodiment of the present invention.

Referring to FIG. 1, there is shown the fuel system 10 for use in a vehicle in accordance with the preferred embodiment of the present invention. The fuel system 10 includes a fuel tank 12, a fuel line 14 in communication with the fuel tank 12, a carburetor 16, a return line 18 and a nozzle 20. The carburetor 16 has an inlet side 22 and an outlet side 24. In particular, the carburetor 16 has a primary fuel bowl 26 and a secondary fuel bowl 28. The fuel line 14 is connected to the inlet side 22 of the carburetor 16 so as to pass fuel into the fuel bowls 26 and 28 of the carburetor 16.

The return line 18 is connected to the outlet side 24 of the carburetor 16. The return line 18 also communicates with the fuel tank 12. In particular, the return line 18 is connected to the primary fuel bowl 26 and the secondary fuel bowl 28 of the carburetor 16.

As shown in FIG. 1, the carburetor 16 of the fuel system 10 is a conventional carburetor. Conventional carburetors usually have the outlet side 24 of the carburetor 16 sealed. Outlets 30 and 32 of the carburetor 16 open, respectively, to the primary fuel bowl 26 and the secondary fuel bowl 28. In the present invention, the return line 18 is connected to these outlets 30 and 32 so as to carry out the important purpose of the present invention.

As can been in FIG. 1, the fuel line 14 extends in a circuitous manner from the fuel tank 12 to the carburetor 16. A fuel pump 34 is connected along the fuel line 14 so as to pass fuel from the fuel tank 12 at a desired rate to the inlet side 22 of the carburetor 16. Under certain circumstances, a fuel regulator 36 can be placed upon the fuel line 14. Additionally, a fuel filter 38 can also be placed along the fuel line 14 so as to filter the fuel prior to introduction into the inlet side 22 of the carburetor 16.

The inlet side 22 of the carburetor 16 has a first inlet 40 and a second inlet 42 formed thereon in a conventional manner. It can be seen that the fuel line 14 is split so as to have a first portion 44 connected to the inlet 40 and a second portion 46 connected to the second inlet 42 on the inlet side 22 of carburetor 16. Each of the portions 44 and 46 communicate with the fuel line 14. In this manner, fuel is delivered, in a conventional manner, into the fuel bowls 26 and 28 of carburetor 16.

The return line 18 includes a first portion 50 and a second portion 52 that are respectively connected to the outlets 30 and 32 of the primary fuel bowl 26 and the secondary fuel bowl 28 of carburetor 16. The nozzle 20 is positioned downstream of both of the portions 50 and 52. As such, excess fuel and/or gases can pass through the portions 50 and 52 and through an orifice of the nozzle 20.

Figure 2:
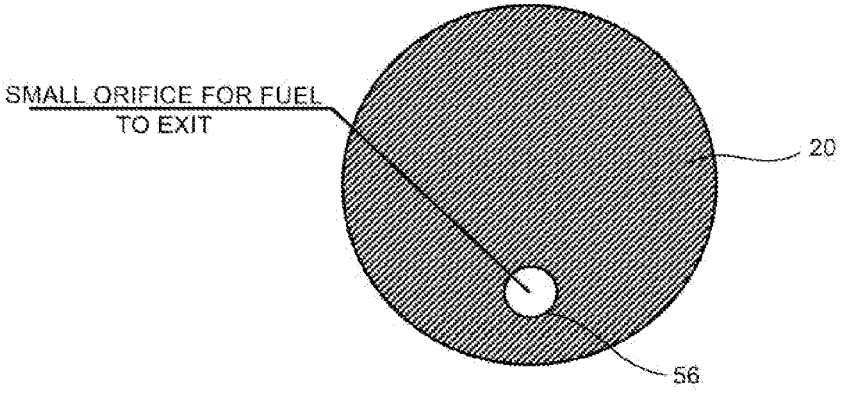
FIG. 2 is a cross-sectional view of the tapered nozzle as used in the fuel return line of the fuel system of the present invention.

The nozzle 20 is tapered so as to have a wide end adjacent to the outlet side 24 of the carburetor 16 and a narrow end opposite to this wide end. The tapered nozzle 20 will have an orifice extending therethrough (as illustrated in FIG. 2) so as to allow a small amount of the fuel to pass into the return line 18. Fuel can pass through the return line 18 and back into the fuel tank 12.

The fuel line return system of the present invention acts as a cooling source by allowing a small amount of excess fuel to exit through the outlets 30 and 32 at the outlet side 24 of carburetor 16. The tiny orifice of the tapered nozzle 20 governs the amount of excess fuel that is allowed to escape the carburetor 16 and return to the fuel tank 12. As the fuel travels up the needle-and-seat 60 through the inlet side 22 of carburetor 16, the fuel enters the fuel bowls 26 and 28 normally. The small amount of fuel that exits through the outlets 30 and 32 serves not only to dissipate the built-up heat, but also allows for a constant circulation of fuel in the system 10. This effectively cools down not only the fuel itself, but all components that come into contact with the fuel. This ability to create a temperature decrease in the fuel ultimately allows for higher efficiency in the operation of the carburetor 16 as well as substantially lowering, if not totally eliminating, the possibility of vapor lock.

The sealing relationship between the outer surface of the nozzle 20 with the inner wall of the return line 18 provides a dam which will block excess fuel from passing back to the fuel tank 12. It is only intended in the present invention that a small amount of the fuel pass through the orifice of the nozzle 20. As such, there will be no decrease in efficiency of the operation of the carburetor by allowing excess fuel to flow back to the fuel tank.

FIG. 2 is a cross-sectional illustration of the nozzle 20. As can be seen, the orifice 56 extends through the interior of the nozzle 20. Orifice 56 is an extremely small orifice having a diameter of between 0.005 and 0.050 inches. Preferably, the diameter of the orifice is 0.031 inch. As can be seen in FIG. 2, the orifice 56 is positioned off center of the nozzle 20 generally adjacent to the bottom of the return line 18. As such, as fuel settles, by gravity, toward the bottom of the return line 18, the fuel will be in a proper position for entry into the orifice 56. This allows for a very efficient passage of the fuel from the fuel bowls 26 and 28 through the nozzle 20.

Figure 3:
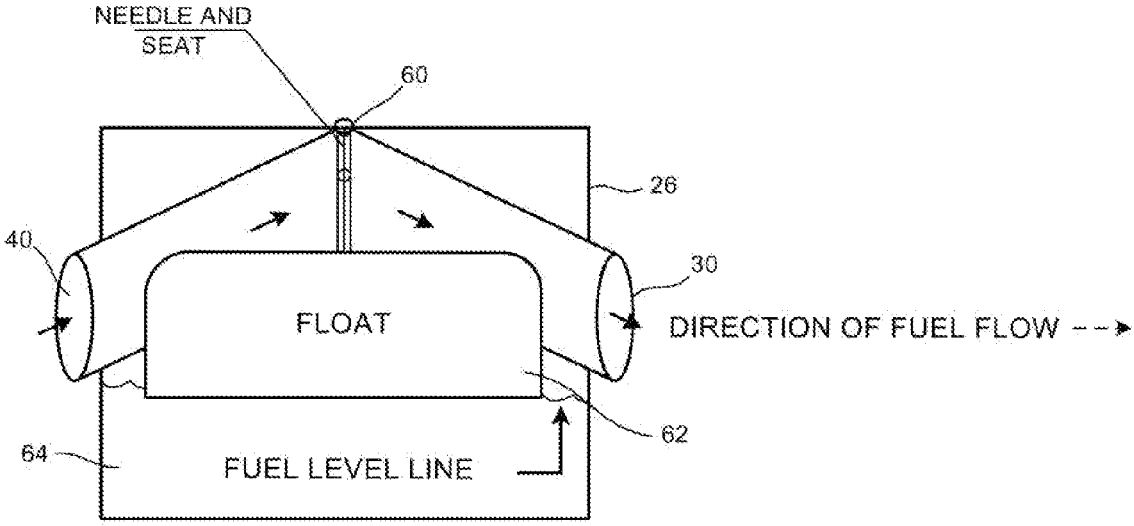
FIG. 3 is a diagrammatic illustration of the fuel bowl of the carburetor as used with the fuel system in accordance with the teachings of the preferred embodiment of the present invention.

FIG. 3 is a diagrammatic illustration of the fuel bowl 26. As can be seen, the inlet 40 allows fuel to pass from the first portion 44 of fuel line 14 into the interior of the fuel bowl 26. A needle-and-seat 60 is connected to a float 62. The float 62 is supported on fuel 64 within fuel bowl 26. When excess fuel enters the fuel bowl 26, a certain amount of the fuel will pass outwardly of the fuel bowl through the outlet 30. As such, fuel can pass toward the nozzle 20 and achieve the advantages of the present invention. The fuel passing through the outlet 30 can be retained by the surface of the nozzle 20 if excess fuel should flow. If excess fuel should accumulate against the back surface of the nozzle 20, then the carburetor 16 will continue to operate in a conventional manner. Only a portion of this excess fuel will pass the orifice 56 and through the return line 18. The secondary fuel bowl 28 will have a similar configuration as fuel bowl 26.

The foregoing disclosure and description of the invention is illustrative and explanatory thereof. Various changes in the details of the illustrated construction can be made within the scope of the appended claims without departing from the true spirit of the invention. The present invention should only be limited by the following claims and their legal equivalents.

I claim:

1. A fuel system for a vehicle comprising: a fuel tank; a fuel line in communication with said fuel tank; a carburetor having a fuel bowl, said fuel bowl having an inlet side and an outlet side, said fuel line connected to said inlet side of said fuel bowl so as to pass fuel into said fuel bowl;

a return line connected horizontally to said outlet side of said fuel bowl, said return line communicating with said fuel tank; and a nozzle positioned horizontally in said return line, said nozzle having an orifice formed there through, said orifice positioned off-center of said nozzle adjacent a bottom of said nozzle and a bottom of said return line, said nozzle being adjacent the outlet side of the fuel bowl.

2. The fuel system of claim 1, said orifice having a diameter of between 0.005 and 0.050 inches.

3. The fuel system of claim 1, said orifice having a diameter of approximately 0.031 inch.

4. The fuel system of claim 1, said nozzle being tapered so as to have a wide end adjacent said outlet side of said fuel bowl and a narrow end opposite said wide end.

5. The fuel system of claim 1, said return line being separate from said fuel line.

6. The fuel system of claim 1, further comprising:

a fuel pumping means connected to said fuel line for passing fuel at a desired rate from said fuel tank through said fuel line to said inlet side of said fuel bowl of said carburetor.

7. The fuel system of claim 1, said carburetor having a pair of outlets at said outlet side, said return line being split into a first portion connected to one of said pair of outlets and a second portion connected to an other of said pair of outlets, said nozzle positioned at a downstream side of both of said first and second portions of said return line.

8. The fuel system of claim 7, said carburetor having a pair of inlets at said inlet side, said fuel line being split into a first portion connected to one of said pair of inlets and a second portion connected to an other of said pair of inlets.

9. The fuel system of claim 8, said fuel bowl of said carburetor comprising a primary fuel bowl and a secondary fuel bowl, said one of said pair of inlets connected to said primary fuel bowl, said other of said pair of inlets connected to said secondary fuel bowl, said one of said pair of outlets connected to said primary fuel bowl, said other of said pair of outlets connected to said secondary fuel bowl.

10. The fuel system of claim 1, said nozzle being in a sealed relationship with an inner wall of said return line.

11. An apparatus for connection to an outlet side of a fuel bowl of a carburetor, the apparatus comprising:

a return line having an end suitable for a horizontal connection to the outlet side of the fuel bowl; and a nozzle horizontally affixed within said return line, said nozzle having an orifice extending there through, said orifice positioned off-center of said nozzle adjacent a bottom of said nozzle and a bottom of said return line, said nozzle being adjacent the outlet side of the fuel bowl.

12. The apparatus of claim 11, said orifice having a diameter of between 0.005 and 0.050 inches.

13. The apparatus of claim 11, said orifice having a diameter of approximately 0.031 inch.

14. The apparatus of claim 11, said nozzle being tapered so as to have a wide end adjacent said outlet side of said fuel bowl and a narrow end opposite said wide end.

15. The apparatus of claim 11, further comprising:

a fuel tank in communication with an opposite end of said return line.

16. The apparatus of claim 11, said return line being split into a first portion and a second portion, said nozzle positioned at a downstream side of both of said first and second portions of said return line, said first portion connecting to a first outlet at the outlet side of the fuel bowl, said second portion connecting to a second outlet at the outlet side of the fuel bowl.

17. The apparatus of claim 16, said nozzle positioned downstream of both of said first and said second portions of said return line.

18. The apparatus of claim 11, said nozzle being in a sealed relationship with an inner wall of said return line.

* * * * *